US007979020B2

(12) United States Patent
Tomatsu

(10) Patent No.: US 7,979,020 B2
(45) Date of Patent: Jul. 12, 2011

(54) IMAGE FORMING APPARATUS

(75) Inventor: Yoshiya Tomatsu, Kasugai (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 1085 days.

(21) Appl. No.: 11/585,799

(22) Filed: Oct. 25, 2006

(65) Prior Publication Data

US 2007/0092322 A1 Apr. 26, 2007

(30) Foreign Application Priority Data

Oct. 26, 2005 (JP) ..... 2005-311613

(51) Int. Cl.
*G03G 15/00* (2006.01)
*B65H 29/70* (2006.01)
*B65H 85/00* (2006.01)

(52) U.S. Cl. ..... 399/406; 399/122; 399/390; 399/401; 399/405

(58) Field of Classification Search ..... 399/406, 399/122, 390, 401, 405
See application file for complete search history.

(56) References Cited

U.S. PATENT DOCUMENTS

| | | | | |
|---|---|---|---|---|
| 5,953,575 | A * | 9/1999 | Park et al. | 399/401 |
| 2004/0228665 | A1 * | 11/2004 | Tomatsu | 399/322 |
| 2007/0070171 | A1 | 3/2007 | Matsuno | |

FOREIGN PATENT DOCUMENTS

| | | | |
|---|---|---|---|
| JP | 63-056152 | U | 4/1988 |
| JP | 03-056355 | A | 3/1991 |
| JP | 6-156852 | | 6/1994 |
| JP | 9-281827 | | 10/1997 |
| JP | 10-129912 | A | 5/1998 |
| JP | 2000-226149 | | 8/2000 |
| JP | 2000335810 | A * | 12/2000 |
| JP | 2002-341681 | | 11/2002 |
| JP | 3095204 | U | 7/2003 |
| JP | 2004-139118 | | 5/2004 |
| JP | 2004-177880 | | 6/2004 |

OTHER PUBLICATIONS

Translation of Tanda (JP 63-056152).*
Notification of Reasons for Refusal for corresponding Japanese Patent Application 2005-311613 mailed Oct. 26, 2010.

* cited by examiner

*Primary Examiner* — Daniel J Colilla
*Assistant Examiner* — Andy L Pham
(74) *Attorney, Agent, or Firm* — Banner & Witcoff, Ltd.

(57) ABSTRACT

An image forming apparatus which forms an image electrophotographically, comprises an image transfer unit which transfers a toner image to a recording medium, a fixing unit comprising a heat roller and a pressure roller, a conveying direction change unit which changes a conveying direction of the recording medium discharged from the fixing unit upwardly, a discharge roller which discharges the recording medium, of which conveying direction has been changed by the conveying direction change unit, to a discharge part, and a curl removing roller which is provided on a conveying extending between the conveying direction change unit and the discharge roller and bends the recording medium in an opposite direction from a bend direction imparted to the recording medium at the heat roller.

9 Claims, 3 Drawing Sheets

IMAGE FORMING APPARATUS

CROSS-REFERENCE TO RELATED APPLICATION

This application claims priority from Japanese Patent Application No. 2005-311613, filed on Oct. 26, 2005, the entire subject matter of which is incorporated herein by reference.

TECHNICAL FIELD

Aspects of the present invention relate to an image forming apparatus such as a laser printer, which forms an image electrophotographically.

BACKGROUND

As is hitherto known, while rotating a photosensitive drum of an image transfer unit, an electrophotographic image forming apparatus transfers a toner deposited on a cylinder surface of the photosensitive drum onto a recording medium such as a paper sheet or an OHP sheet. The electrophotographic image forming apparatus then heats the toner transferred on the recording medium by a heat roller, and fixes the toner on the recording medium to form an image on the recording medium.

When the recording medium is heated by the heat roller, the part on the heat roller side of the recording medium thermally shrinks. Accordingly, the recording medium tends to bend (curl) in such a manner as to curl around the heat roller.

JP-A-2004-177880 discloses a structure, in which a roller having a curl removing function (which is hereinafter referred to as a curl removing roller) is provided just behind the heat roller, thereby to remove the curl.

The curl removing roller removes curl in the following manner. The curl removing roller imparts curl in the opposite direction from the direction of the generated curl to the recording medium, and thereby cancels out the already generated curl.

SUMMARY

Incidentally, in a general electrophotographic image forming apparatus, a toner is transferred on the upper side of a recording medium during conveyance of the recording medium. Therefore, a heat roller is also provided on the upper side of the recording medium. For this reason, the recording medium discharged from the heat roller has such a direction of bend as to be downwardly convex such that the center of curvature is present on the heat roller side. Therefore, the leading end side in the conveying direction of the recording medium discharged from the heat roller goes upward.

On the other hand, the curl removing roller imparts curl in the opposite direction from the direction of the curl generated at the heat roller. Therefore, the leading end side in the conveying direction of the recording medium discharged from the curl removing roller goes downward.

In a general electrophotographic image forming apparatus, the conveying direction of the recording medium, which has finished fixing of a toner at the heat roller, is changed upward in the vertical direction. When a curl removing roller is provided just behind the heat roller, since the conveying direction of the recording medium discharged from the curl removing roller points downward, the conveying direction of the recording medium discharged from the curl removing roller is required to be changed by 90° or more so as to convey the recording medium upward.

The smooth change of the conveying direction requires a conveying path (conveying guide) bent so as to have a large radius of curvature. Therefore, change of the conveying direction by 90° or more requires a conveying path bent so as to have a still larger radius of curvature. This entails an increase in size of the image forming apparatus.

In order for the curl removing roller to exert a sufficient curl removing effect, it is preferable to increase the diameter of the curl removing roller. However, when the diameter of the curl removing roller is increased, the conveying direction of the recording medium discharged from the curl removing roller points still more downward. This further entails an increase in size of the image forming apparatus.

Aspects of the invention provide an image forming apparatus that removes the curl generated at the heat roller while achieving the size reduction of the image forming apparatus.

DETAILED DESCRIPTION

<General Overview>

Figure 1:
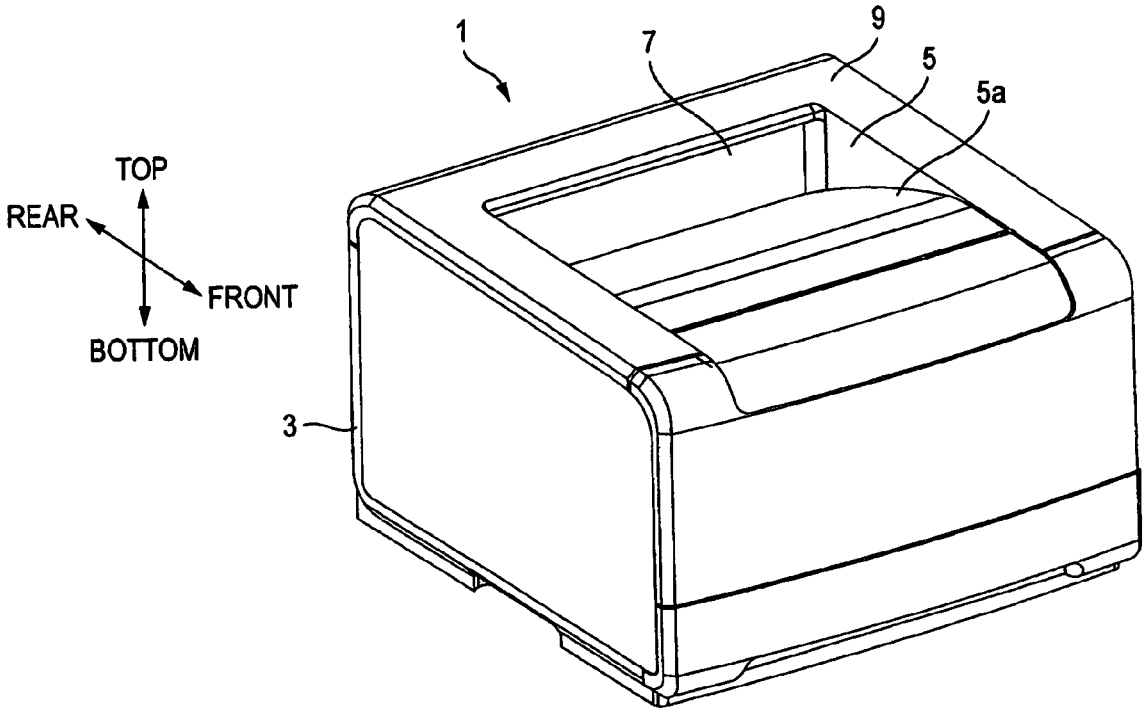
FIG. 1 is a perspective view showing an outward appearance of a laser printer according to an aspect of the present invention.

According to a first aspect of the invention, there is provided an image forming apparatus which forms an image electrophotographically, comprising: an image transfer unit which transfers a toner image to a recording medium; a fixing unit comprising: a heat roller which imparts a transfer force to the recording medium while heating a toner of the toner image transferred onto the recording medium by the image transfer unit; and a pressure roller which is set on a side below the heat roller and presses the recording medium against the heat roller side; a conveying direction change unit which changes a conveying direction of the recording medium discharged from the fixing unit upwardly a discharge roller which discharges the recording medium, of which conveying direction has been changed by the conveying direction change unit, to a discharge part; and a curl removing roller which is provided on a conveying path extending between the conveying direction change unit and the discharge roller and bends the recording medium in an opposite direction from a bend direction imparted to the recording medium at the heat roller.

According to a second aspect of the invention, the conveying direction change unit changes a conveying direction of the recording medium discharged from the fixing unit upwardly by substantially 90°.

The heat roller is provided on the side above the pressure roller. Therefore, the recording medium discharged from the fixing unit is bent downwardly convex.

Therefore, the leading end side in the conveying direction of the recording medium discharged from the heat roller goes upward. Accordingly, it is possible to smoothly change the conveying direction of the recording medium upwardly by substantially 90° without disposing a conveying path (conveying guide) bent so as to have a large radius of curvature.

The curl removing roller is provided in the conveying path extending between the conveying direction change unit and the discharge roller, i.e., behind the position at which the conveying direction of the recording medium is changed upwardly by substantially 90°. Therefore, there is almost no effect on the radius of curvature of the conveying path extending between the conveying direction change unit and the discharge roller.

Therefore, it is possible to unaffectedly turn the recording medium discharged from the fixing unit upwardly in the vertical direction by substantially 90°. Therefore, it is possible to change the conveying direction without increasing the radius of curvature of the conveying path. This can suppress the increase in size of the image forming apparatus.

The presence of the curl removing roller hardly affects the radius of curvature of the conveying path from the conveying direction change unit to the discharge roller. Therefore, even when the diameter of the curl removing roller is increased, it is possible to suppress the increase in size of the image forming apparatus.

Accordingly, it is possible to remove the curl generated at the heat roller while achieving the size reduction of the image forming apparatus.

According to a third aspect of the invention, the image forming apparatus further comprises a conveying direction inward change unit which is provided between the conveying direction change unit and the curl removing roller of the conveying path and imparts a conveying direction component directed toward the fixing unit to the recording medium conveyed from the conveying direction change unit to the curl removing roller.

As a result, the conveying direction of the recording medium has been changed upwardly by substantially 90° with the conveying direction change unit. The recording medium is conveyed toward the curl removing roller in such a manner as to incline toward the fixing unit side, i.e., toward the inside of the image forming apparatus with a conveying direction inward change unit.

Therefore, as compared with the case where the conveying direction has been simply changed in the vertical direction with the conveying direction change unit (32), the curl removing roller (40) can be provided more inwardly of the image forming apparatus. This can further reduce the size of the image forming apparatus.

According to a fourth aspect of the invention, the image forming apparatus comprises: a first nipping roller which is provided opposite to the curl removing roller; and a second nipping roller which is provided opposite to the curl removing roller at a side closer to the discharge roller than the first nipping roller.

According to a fifth aspect of the invention, a first tangential line at a contact point between the second nipping roller and the curl removing roller inclines with respect to a vertical direction.

According to a sixth aspect of the invention, a second tangential line at a contact point between the first nipping roller and the curl removing roller inclines with respect to a vertical direction, and an imaginary extension line of the second tangential line crosses with an imaginary extension line of the first tangential line.

The recording-medium which has reached the curl removing roller comes to wind around the curl removing roller in the circular arc region of from the contact point between the curl removing roller and the first nipping roller to the contact point between the curl removing roller and the second nipping roller. Thus, the curl removing function is more effective as the amount of the recording medium to wind around the curl removing roller, i.e., the size of the circular arc region increases.

It is configured such that the retreating side in the conveying direction of the recording medium at the contact point between the curl removing roller (40) and the first nipping roller (41) points to the rear side. Further, the second nipping roller (42) is provided so that the advancing side in the conveying direction of the recording medium at the contact point between the curl removing roller (40) and the second nipping roller (42) points to the rear side. Therefore, it is possible to make the circular arc region relatively large. Accordingly, it is possible to allow the curl removing function to be effectively exerted.

Incidentally, the conveying direction represents the conveying direction of the recording medium during single-side printing, or during the first printing in the case of double-side printing.

According to a seventh aspect of the invention, the image forming apparatus further comprises: a conveying direction reversing unit which reverses the conveying direction of the recording medium having passed through the curl removing roller and returns the recording medium to the curl removing roller; and a double-side printing conveying unit which conveys the returned recording medium.

As a result, during double-side printing, the recording medium passes through the curl removing roller twice. Thus, it is possible to remove the curl generated in the recording medium with reliability.

According to an eighth aspect of the invention, the image forming apparatus further comprises: a conveying direction reversing unit which reverses the conveying direction of the recording medium having passed through the curl removing roller and returns the recording medium to the curl removing roller; and a path forming unit which forms a double-side printing conveying path for conveying the returned recording medium, wherein the conveying direction inward change unit has a guide plane inclining with respect to a vertical direction, and wherein an inlet part of the double-side printing conveying path has a wall surface which is continued from the guide plane.

As a result, during double-side printing, the recording medium passes through the curl removing roller twice. Thus, it is possible to remove the curl generated in the recording medium with reliability.

According to a ninth aspect of the invention, the wall surface of the inlet part of the double-side printing conveying path is smoothly continued from the guide plane. Accordingly, the returned recording medium is guided to the double-side printing conveying path in such a manner that the leading end in the conveying direction is along the guide plane and the wall surface.

Therefore, without providing a path switching unit for switching between the conveying path through which the recording medium is conveyed during front surface printing and the conveying path through which the recording medium is conveyed during back surface printing, it is possible to appropriately control conveyance of the recording medium.

<Illustrative Aspects>

Now, description will be given of an illustrative aspect of an image forming apparatus with reference to the accompanying drawings.

1. Overall Configuration of Laser Printer

FIG. 1 is a perspective view showing an outward appearance of a laser printer 1. The laser printer 1 is set such that the top side in the sheet of FIG. 1 is the upper side in the direction of gravity. The laser printer 1 is used with the near side of the sheet of FIG. 1 being the front side.

A housing 3 of the laser printer 1 is formed substantially in a box shape (cubic shape). On the top side of the housing 3, there is provided a sheet discharge tray 5 for mounting, thereon a recording medium which has been subjected to printing and has been discharged from the housing 3. Incidentally, the recording medium may be a paper or OHP sheet.

The sheet discharge tray 5 is formed of an inclined plane 5*a* inclining downwardly from the top side of the housing 3 toward the rear side. On the rear end side of the inclined plane 5*a*, there is provided a discharge part 7 from which the recording medium is discharged.

2. Schematic Configuration of Laser Printer

Figure 2:
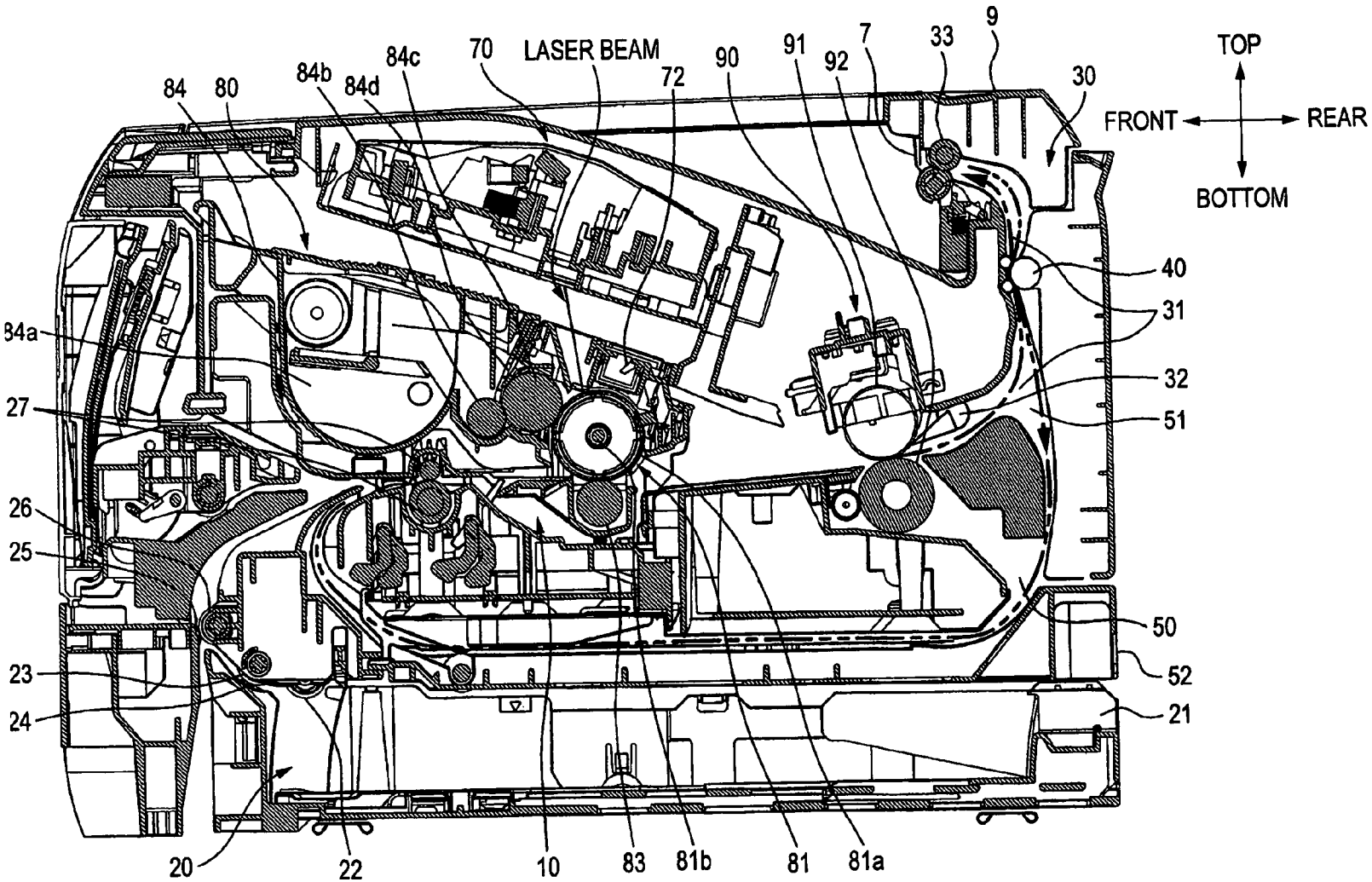
FIG. 2 is a sectional view showing the laser printer.

FIG. 2 is a sectional view showing the laser printer 1. An image forming part 10 forms an image forming unit which forms an image on a recording medium. A feeder part 20 forms a part of a conveying unit which feeds a recording medium to the image forming part 10.

A discharge shoot 30 forms a guide member for changing a conveying direction of the recording medium, which has been subjected to the image formation at the image forming part 10, by substantially 180° in such a manner as to cause U-turn and for guiding the recording medium to the discharge part 7 provided above a fixing unit 90.

At the intermediate part of a conveying path 31 of the recording medium formed of the discharge shoot 30, there is provided an intermediate conveying roller 40 for conveying the recording medium to the discharge part 7. On the upstream side of the conveying path 31 and on the downstream side of the fixing unit 90, there is provided a change roller 32 for changing the conveying direction of the recording medium discharged from the fixing unit 90 (heat roller 91) toward the upper side by substantially 90°. At the most downstream part of the conveying path 31, a discharge roller 33 is provided.

The discharge roller 33 discharges the recording medium conveyed through the intermediate conveying roller 40 from the discharge part 7 to the sheet discharge tray 5. For double-side printing, the discharge roller 33 constitutes a conveying direction reversing unit by rotating in an opposite direction thereby to turn around the conveying direction of the recording medium.

2.1. Feeder Part

The feeder part 20 is configured to have a sheet feed tray 21 accommodated in the lowermost part of the housing 3, a sheet feed roller 22 provided above the front edge of the sheet feed tray 21 for feeding a recording medium to the image forming part 10, and a separation roller 23 and a separation pad 24 for separating the recording media fed by the sheet feed roller 22 to further feed one by one, and the like. The recording medium mounted in the sheet feed tray 21 is conveyed to the image forming part 10 set at substantially the central part of the housing 3 in such a manner as to make a U-turn on the front side of the inside of the housing 3.

A paper dust removing roller 25 for removing a paper dust on an image forming face (printed surface) of the recording medium is provided at the outside of an apex of the U-turn formed by the conveying path extending from the sheet feed tray 21 to the image forming part 10. At the inside of the apex, there is provided an opposing roller 26 for pressing the conveyed recording medium against the paper dust removing roller 25.

At the inlet of the image forming part 10 in the conveying path extending from the sheet feed tray 21 to the image forming part 10, register rollers 27 formed of a pair of rollers for imparting the conveying resistance to the recording medium and adjusting the conveying condition of the recording medium are provided.

2.2. Image Forming Part

The image forming part 10 is configured to have a scanner part 70, a process cartridge 80, the fixing unit 90, and the like.

2.2.1. Scanner Part

The scanner part 70 is provided at the top of the inside of the housing 3 and forms an electrostatic latent image on the surface of a photosensitive drum 81 described later. Specifically, the scanner part 70 includes a laser light source, a polygon mirror, an fθ lens, reflecting mirrors, and the like.

A laser beam based on the image data radiated from the laser light source is deflected by the polygon mirror and passes through the fθ lens. The optical path is bent back by the reflecting mirror, and then the optical path is further bent downwardly by the reflecting mirror. As a result, the laser beam is applied onto the surface of the photosensitive drum 81, so that an electrostatic latent image is formed.

2.2.2. Process Cartridge

The process cartridge 80 is set detachably below the scanner part 70 in the housing 3. The process cartridge 80 constitutes an image transfer unit for transferring a toner image to a recording medium. The process cartridge 80 includes the photosensitive drum 81, a charger 82, a transfer roller 83, a development cartridge 84, and the like.

The photosensitive drum 81 forms an image carrying unit which carries thereon an image to be transferred to a recording medium. The photosensitive drum 81 is configured to have a cylindrical drum main body 81*a* of which the outermost layer is formed of a positively chargeable photosensitive layer including polycarbonate or the like, and a drum shaft 81*b* extending along the longitudinal direction of the drum main body 81*a* and rotatably supporting the drum main body 81*a* at the axis of the drum main body 81*a*.

The charger 82 forms a charging unit which charges the surface of the photosensitive drum 81. The charger 82 is provided opposite to the photosensitive drum 81 with a prescribed space therebetween so as not to come in contact with the photosensitive drum 81 obliquely above the rear side of the photosensitive drum 81. Incidentally, as the charger 82, a scorotron type charger for positively charging the surface of the photosensitive drum 81 substantially uniformly utilizing corona discharge may be employed.

The transfer roller 83 is provided opposite to the photosensitive drum 81 and forms a transfer unit which transfers the toner deposited on the surface of the photosensitive drum 81 onto the printed surface of the recording medium in the following manner. The transfer roller 83 rotates in synchronization with the rotation of the photosensitive drum 81. The transfer roller 83 allows a charge (a negative charge) opposite from the charge born on the photosensitive drum 81 to act on the recording medium from the opposite side from the printed surface when the recording medium passes through the vicinity of the photosensitive drum 81.

The development cartridge 84 is configured to have a toner accommodation chamber 84*a* in which a toner is accommodated, a toner supply roller 84*b* for supplying the toner to the photosensitive drum 81, a development roller 84*c*, and the like.

The toner accommodated in the toner accommodation chamber 84*a* is supplied to the development roller 84*c* side by the rotation of the toner supply roller 84*b*. Further, the toner supplied to the development roller 84*c* side is carried on the surface of the development roller 84*c*. In addition, the thickness of the carried toner is controlled to be constant (uniform) by a layer thickness regulating blade 84*d*. The toner is supplied onto the surface of the photosensitive drum 81 exposed to light by the scanner part 70.

2.2.3. Fixing Unit

The fixing unit 90 is provided on the downstream side of the photosensitive drum 81 in the conveying direction of the recording medium. The fixing unit 90 heats, melts and fixes the toner transferred onto the recording medium. Specifically, the fixing unit 90 includes the heat roller 91 provided on the printed surface side of the recording medium for imparting a conveying force to the recording medium while heating the toner, and a pressure roller 92 provided below the heat roller 91 with the recording medium interposed therebetween. The pressure roller 92 presses the recording medium against the heat roller 91.

Incidentally, the heat roller 91 is driven by a driving unit such as a motor (not shown). On the other hand, the pressure roller 92 is rotated in a driven manner by receiving the rotational force from the heat roller 91 via the recording medium in contact with the heat roller 91.

The image forming part 10 forms an image on the recording medium in the following manner.

Namely, the surface of the photosensitive drum 81 is positively charged uniformly in accordance with rotation thereof by the charger 82. Then, the photosensitive drum 81 is exposed to light by high speed scanning with a laser beam applied from the scanner part 70. As a result, an electrostatic latent image corresponding to the image to be formed on the recording medium is formed on the surface of the photosensitive drum 81.

When the toner carried on the development roller 84*c* and positively charged faces and comes into contact with the photosensitive drum 81 by rotation of the development roller 84*c*. The toner is supplied to the electrostatic latent image formed on the surface of the photosensitive drum 81, i.e., the exposed portion exposed to a laser beam and reduced in electric potential out of the uniformly and positively charged surface of the photosensitive drum 81. As a result, the electrostatic latent image on the photosensitive drum 81 is converted into a visible image. Thus, on the surface of the photosensitive drum 81, a toner image by reversal development is carried.

Thereafter, the toner image carried on the surface of the photosensitive drum 81 is transferred to the recording medium by a transfer bias applied to the transfer roller 83. The recording medium on which the toner image has been transferred is conveyed to the fixing unit 90 and is heated. Thus, the toner transferred as the toner image is fixed on the recording medium to complete image formation.

2.3. Discharge Shoot 30, Conveying Path, and the Like

Figure 3:
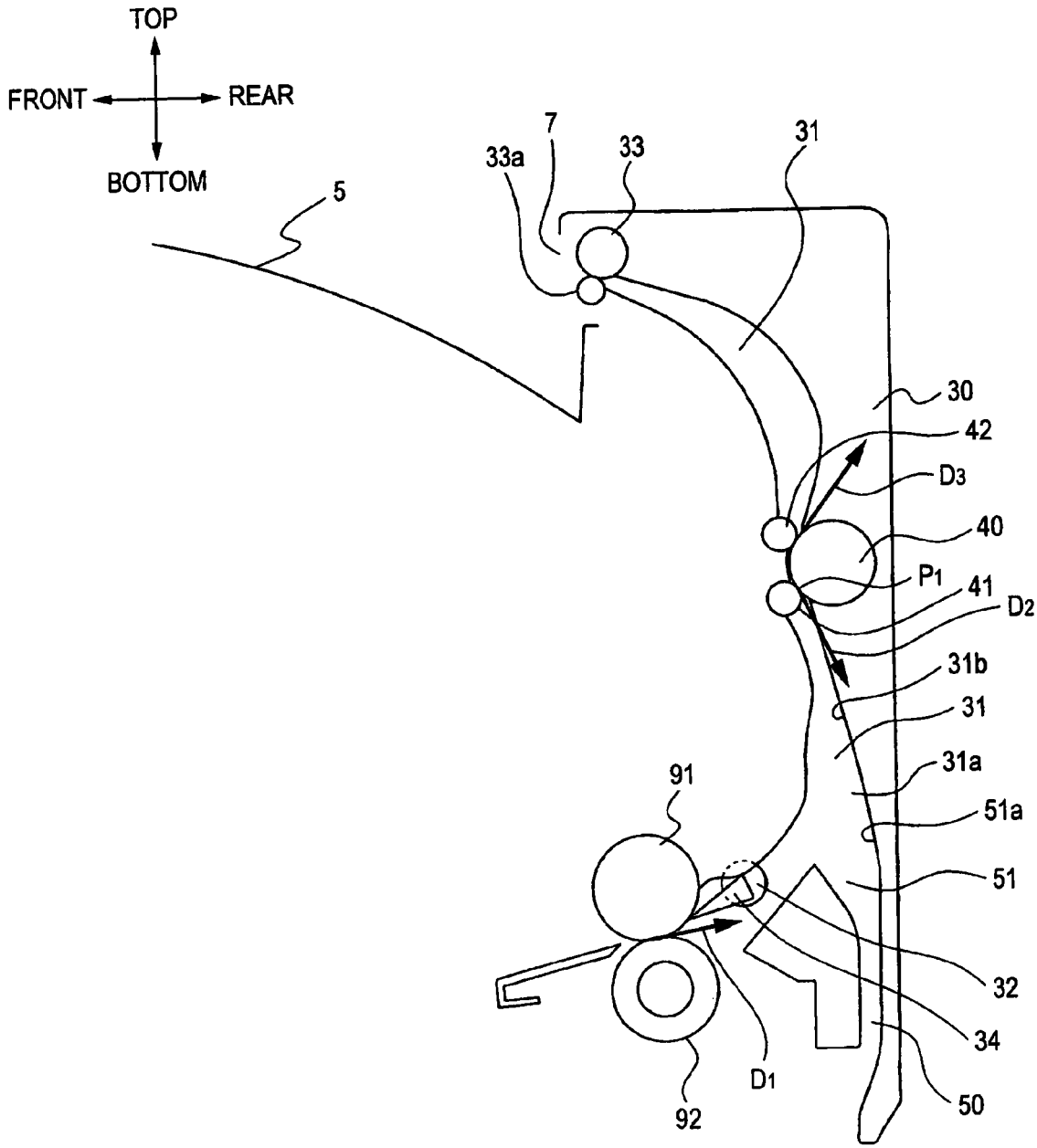
FIG. 3 is an enlarged schematic view of a discharge shoot and a conveying path in the laser printer.

FIG. 3 is an enlarged schematic view of the discharge shoot 30 and the conveying path 31.

As shown in FIG. 3, the discharge shoot 30 constitutes a guide wall for turning the recording medium discharged from the fixing unit 90 (heat roller 91) upwardly by substantially 90°, then turning the recording medium substantially in the horizontal direction again, thereby turning the recording medium discharged from the fixing unit 90 by substantially 180°, and thus guiding the recording medium to the discharge roller 33. On the upstream side of the conveying direction of the change roller 32, there is provided a releasing blade 34 for releasing the recording medium heated by the heat roller 91 from the heat roller 91.

The intermediate conveying roller 40 provided at the intermediate part of the conveying path 31 exerts such a pressing force as to make the recording medium, which has been bent in a substantially U-shape by the heat roller 91 such that the center of curvature is present on the heat roller 91 side, convex in the opposite direction (toward the front side).

In other words, in addition to the bend (curl) by the heat roller 91, the conveying path 31 is bent by 180° in the transfer path 31. As a result, in the transfer path 31, the recording medium is bent so as to be convex to the rear side. Thus, a pressing force such that the recording medium is bent so as to be convex to the front side is applied at the intermediate conveying roller 40.

The term "rear side" represents the advancing side D1 in the conveying direction of the recording medium at the contact point between the heat roller 91 and the recording medium. The term "rear side" corresponds to the rear side of the laser printer 1.

On the opposite side of the intermediate conveying roller 40 across the conveyed recording medium, first and second nipping rollers 41 and 42 are provided opposite to the intermediate conveying roller 40 in such a manner as to nip the recording medium between the nipping rollers 41, 42 and the intermediate conveying roller 40. These first and second nipping rollers 41 and 42 are pressed toward the intermediate transfer roller 40 by an elastic member (not shown) such as a spring, and rotate in a driven manner in synchronization with the conveyed recording medium.

The first nipping roller 41 on the upstream side of the conveying direction is set such that the upstream side D2 in the conveying direction of the recording medium at the contact point between the intermediate conveying roller 40 and the first nipping roller 41 points to the rear side. The second nipping roller 42 on the downstream side of the conveying direction is set such that the downstream side D3 in the conveying direction of the recording medium at the contact point between the intermediate transfer roller 40 and the second nipping roller 42 points to the rear side.

Incidentally, the terms "the advancing side in the conveying direction" and "the retreating side in the conveying direction" each represent the conveying direction of the recording medium during single-side printing. Specifically, each represents the conveying direction when the recording medium is transferred from the bottom side to the top side of FIG. 3.

Incidentally, an imaginary extension line of the tangential line at the contact point between the first nipping roller 41 and the intermediate transfer roller 40 crosses with an imaginary extension line of the tangential line at the contact point between the second nipping roller 42 and the intermediate transfer roller 40.

In the transfer path extending from the change roller 32 to the intermediate conveying roller 40, there is provided an expanded space 31*a* expanding from the contact point P1 between the intermediate conveying roller 40 and the recording medium, i.e., the contact point between the intermediate conveying roller 40 and the first nipping roller 41 to the rear side. The expanded space 31*a* is configured so as to gradually expand toward the rear side. The expanded space 31*a* is gradually expanded from the contact point P1 toward the upstream side in the conveying direction (the bottom side of the sheet).

A guide wall surface 31*b* forming the expanded space 31*a* is formed in such a manner as to incline with respect to the vertical direction. The guide wall surface 31*b* functions as a conveying direction inward change unit which imparts a conveying direction component toward the fixing unit 90 side (front side) to the recording medium 10 conveyed from the change roller 32 to the intermediate conveying roller 40.

A double-side printing conveying path 50 is a path for conveying again the recording medium, the conveying direction of which has been changed by the discharge roller 33 for double-side printing, to the image forming part 10. An inlet part 51 of the double-side printing conveying path 50 is configured to have a wall surface 51*a* smoothly continued from the guide wall surface 31*b*.

Incidentally, the double-side printing conveying path 50 is configured by a double-side printing unit 52 (see FIG. 2) mounted between the sheet feed tray 21 and the process cartridge 80 (or the fixing unit 90), a portion of the discharge shoot 30 continued from the expanded space 31*a*, and the like.

At the position opposite to the discharge roller 33, a nipping roller 33*a* is provided in such a manner as to interpose the conveyed recording medium therewith. The nipping roller 33*a* is pressed toward the discharge roller 33 by an elastic member (not shown) such as a spring, and rotates in a driven manner in synchronization with the conveyed recording medium.

In the configuration described above, during single-side printing, the recording medium discharged from the fixing unit 90 passes through the intermediate conveying roller 40 and is discharged from the discharge roller 33 to the sheet discharge tray 5.

During double-side printing, the recording medium discharged from the fixing unit 90 passes through the intermediate conveying roller 40 and is conveyed to the discharge roller 33. When the trailing end in the conveying direction of the recording medium reaches the discharge roller 33, the conveying transfer direction is reversed, and the recording medium is conveyed toward the intermediate conveying roller 40 again.

Since the direction D2 at the contact point between the intermediate conveying roller 40 and the first nipping roller 41 points to the rear side, the recording medium, which has passed through the intermediate conveying roller 40, is guided to the double-side printing transfer path 50 in such a manner that the leading end in the conveying direction is guided along the guide wall surface 31*b*.

Incidentally, in FIG. 2, the bold chain line indicates the transfer path for single-side printing, and the bold two-dot chain line indicates the transfer path when the back surface side is printed during double-side printing.

3. Features of Image Forming Apparatus

Also, the heat roller 91 is provided on the side above the pressure roller 92. Therefore, the recording medium discharged from the fixing unit 90 has such a direction of bend as to be downwardly convex as described in the section of "Problems that the Invention is to Solve".

Therefore, the leading end side in the direction of transfer of the recording medium discharged from the heat roller 91 has already pointed upward. Accordingly, it is possible to smoothly change the direction of transfer of the recording medium upwardly by substantially 90° without disposing a transfer path (transfer guide) bent so as to have a large radius of curvature.

The intermediate transfer roller 40 is provided in a transfer path from the change roller 32 till the discharge roller 33, i.e., behind the position at which the direction of transfer of the recording medium is changed upwardly by substantially 90°. Therefore, there is almost no effect on the radius of curvature of the transfer path from the change roller 32 till the discharge roller 33.

Therefore, it is possible to unaffectedly turn the recording medium discharged from the fixing unit 90 upwardly by substantially 90°. Therefore, it is possible to change the transfer direction without increasing the radius of curvature of the transfer path. This can suppress the increase in size of the image forming apparatus.

The presence of the intermediate transfer roller 40 hardly affects the radius of curvature of the transfer path from the change roller 32 till the discharge roller 33. Therefore, even when the diameter of the intermediate transfer roller 40 is increased, it is possible to suppress the increase in size of the image forming apparatus.

As described above, it is possible to remove the curl generated at the heat roller 91 while achieving the size reduction of the image forming apparatus.

The guide wall surface 31*b* is formed in such a manner as to incline with respect to the vertical direction, and imparts a transfer direction component toward the fixing unit 90 side (front side) to the recording medium. Therefore, the recording medium, the transfer direction of which has been changed upwardly by substantially 90° with the transfer roller 32, is transferred toward the intermediate transfer roller 40 in such a manner as to incline toward the fixing unit 90 side, i.e., toward the inside of the image forming apparatus with the guide wall surface 31*b*.

Therefore, as compared with the case where the transfer direction has been simply changed in the vertical direction with the transfer roller 32, the intermediate transfer roller 40 can be provided more inwardly of the image forming apparatus. This can further reduce the size of the image forming apparatus.

Incidentally, the recording medium which has reached the intermediate transfer roller 40 comes to wind around the intermediate transfer roller 40 in the circular arc region of from the contact point between the intermediate transfer roller 40 and the first nipping roller 41 to the contact point between the intermediate transfer roller 40 and the second nipping roller 42. Thus, the curl removing function is more effective as the amount of the recording medium to wind around the intermediate transfer roller 40, i.e., the size of the circular arc region increases.

At this step, it is configured such that the direction of transfer of the recording medium at the contact point between the intermediate transfer roller 40 and the first nipping roller 41 points to the rear side. Further, the second nipping roller 42 is provided so that the direction of transfer of the recording medium at the contact point between the intermediate transfer roller 40 and the second nipping roller 42 points to the rear side. Therefore, it is possible to make the circular arc region relatively large. Accordingly, it is possible to allow the curl removing function to be effectively exerted.

During double-side printing, the recording medium passes through the intermediate transfer roller 40 twice. Thus, it is possible to remove the curl generated in the recording medium with reliability.

Incidentally, during double-side printing, as described above, the direction of rotation of the discharge roller 33 is reversed. However, as a matter of course, it is not possible to impart the transfer force to the recording medium after completion of passage of the recording medium through the discharge roller 33.

Thus, substantially, the direction of rotation of the discharge roller 33 is reversed when (immediately before) the trailing end side in the direction of transfer of the recording medium reaches the discharge roller 33. However, upon (at the instant of) reversing the direction of rotation of the discharge roller 33, a large torque acts on the recording medium. Therefore, the trailing end side of the recording medium may be bent in an L shape, or a so-called cat's paw curl may occur.

However, even when the transfer direction is reversed to perform printing on the rear surface side, curl removal is carried out by passage through the intermediate transfer roller 40. Therefore, it is possible to remove the cat's paw curl generated upon reversing the transfer direction.

The inlet part 51 of the double-side printing transfer path 50 is configured to have a wall surface 51*a* smoothly continued from the guide wall surface 31*b*. Therefore, the recording medium, of which the transfer direction has been reversed, and which has passed through the intermediate transfer roller 40, is guided to the double-side printing transfer path 50 in such a manner that the leading end in the transfer direction is along the guide wall surface 31*b* and the wall surface 51*a*.

Therefore, without providing a path switching unit, such as a flapper, which switches between the transfer path through which the recording medium is transferred during front surface printing and the transfer path through which the recording medium is transferred during back surface printing, it is possible to appropriately control the transfer of the recording medium.

4. Correlation Between the Particular Matters and Aspects of the Invention

The intermediate transfer roller 40 corresponds to the curl removing roller. The change roller 32 corresponds to the transfer direction change unit. The discharge roller 33 also serves as the discharge roller and the transfer direction reversing unit.

The double-side printing transfer path unit is configured of the double-side printing unit 52 (see FIG. 2), the site continued from the expanded space 31*a* out of the discharge shoot 30, and the like.

OTHER EMBODIMENTS

In the foregoing embodiment, the transfer direction change unit is configured of a rotating roller. However, the invention is not limited thereto. The transfer direction change unit may be configured of a guide plane having a curved sliding surface.

The expanded space 31*a* is provided. However, the invention is not limited thereto. The expanded space 31*a* may be taken off.

The discharge roller 33 also serves as the discharge roller and the transfer direction reversing unit described in the claims. However, the invention is not limited thereto. A special purpose roller forming the transfer direction reversing unit may be provided.

It is only essential that the invention is in agreement of the scope of the invention described in claims. The invention is not limited to the embodiments.

What is claimed is:

1. An image forming apparatus which forms an image electrophotographically, comprising:

a housing;

an image transfer unit which is disposed in the housing and transfers a toner image to a recording medium;

a fixing unit which is disposed in the housing and includes:

a heat roller which imparts a transfer force to the recording medium while heating a toner of the toner image transferred onto the recording medium by the image transfer unit; and a pressure roller which is provided on a side below the heat roller and presses the recording medium against the heat roller;

a conveying direction change unit positioned to receive the recording medium from the fixing unit, said conveying direction change unit configured to change a conveying direction of the recording medium to an upward direction;

a discharge tray provided at an upper part of the housing;

a discharge roller which discharges the recording medium, of which the conveying direction has been changed by the conveying direction change unit, on the discharge tray;

a curl removing roller which is provided on a conveying path extending between the conveying direction change unit and the discharge roller between the discharge roller and a nipping point of the heat roller and the pressure roller in a vertical direction of the housing and includes:

an intermediate conveying roller which bends the recording medium in an opposite direction from a bend direction imparted to the recording medium at the heat roller, a first nipping roller which presses the recording medium to the intermediate conveying roller, and a second nipping roller which presses the recording medium to the intermediate conveying roller, the second nipping roller being disposed on a downstream side of the conveying direction with respect to the first nipping roller, and the second nipping roller being vertically aligned with and higher than the first nipping roller, a conveying direction reversing unit, including the discharge roller, which reverses the conveying direction of the recording medium having passed through the curl removing roller and returns the recording medium to the curl removing roller; and a double-side printing conveying unit which conveys the returned recording medium, wherein a tangential direction toward the upstream side at a contact point between the intermediate conveying roller and the first nipping roller inclines outwardly with respect to the vertical direction, and a tangential direction toward the downstream side at a contact point between the intermediate conveying roller and the second nipping roller inclines outwardly with respect to the vertical direction, and wherein a rotation direction of the intermediate conveying roller is reversed during conveyance of the returned recording medium to the double-side printing conveying unit.

2. The image forming apparatus according to claim 1, wherein the conveying direction change unit changes a conveying direction of the recording medium discharged from the fixing unit upwardly by substantially 90°.

3. The image forming apparatus according to claim 1, further comprising a conveying direction inward change unit which is provided between the conveying direction change unit and the curl removing roller of the conveying path and imparts to the recording medium conveyed from the conveying direction change unit to the curl removing roller a conveying direction component directed toward the fixing unit.

4. The image forming apparatus according to claim 3, wherein the first nipping roller is provided opposite to the curl removing roller; and wherein the second nipping roller is provided opposite to the curl removing roller at a side closer to the discharge roller than the first nipping roller.

5. The image forming apparatus according to claim 4, wherein a first tangential line at a contact point between the second nipping roller and the curl removing roller inclines with respect to a vertical direction.

6. The image forming apparatus according to claim 5, wherein a second tangential line at a contact point between the first nipping roller and the curl removing roller inclines with respect to a vertical direction, and wherein an imaginary extension line of the second tangential line crosses with an imaginary extension line of the first tangential line.

7. The image forming apparatus according to claim 3, further comprising:

a path forming unit which forms a double-side printing conveying path for conveying the returned recording medium, wherein the conveying direction inward change unit has a guide plane inclining with respect to a vertical direction, and wherein an inlet part of the double-side printing conveying path has a wall surface which is continued from the guide plane.

8. The image forming apparatus according to claim 7, wherein the wall surface of the inlet part of the double-side printing conveying path is smoothly continued from the guide plane.

9. An image forming apparatus comprising:

a housing;

an image transfer unit which is disposed in the housing and transfers a toner image to a recording medium;

a fixing unit which is disposed in the housing and includes:

a heat roller which imparts a transfer force to the recording medium while heating a toner of the toner image transferred onto the recording medium by the image transfer unit; and a pressure roller which is provided on an opposite side of the recording medium from the heat roller and presses the recording medium against the heat roller, wherein the fixing unit imparts to the recording medium a bend in a first bend direction;

a conveying direction change unit positioned to receive the recording medium from the fixing unit, said conveying direction change unit configured to change a conveying direction of the recording medium by substantially 90°;

a discharge tray provided at an upper part of the housing;

a discharge roller which discharges the recording medium, of which the conveying direction has been changed by the conveying direction change unit, on the discharge tray;

a curl removing roller which is provided on a conveying path extending between the conveying direction change unit and the discharge roller between the discharge roller and a nipping point of the heat roller and the pressure roller in a vertical direction of the housing and includes:

an intermediate conveying roller which bends the recording medium in an opposite direction from a bend direction imparted to the recording medium at the heat roller, a first nipping roller which presses the recording medium to the intermediate conveying roller, and a second nipping roller which presses the recording medium to the intermediate conveying roller, the second nipping roller being disposed on a downstream side of the conveying direction with respect to the first nipping roller, and the second nipping roller being vertically aligned with and higher than the first nipping roller, a conveying direction reversing unit, including the discharge roller, which reverses the conveying direction of the recording medium having passed through the curl removing roller and returns the recording medium to the curl removing roller; and a double-side printing conveying unit which conveys the returned recording medium, wherein a tangential direction toward the upstream side at a contact point between the intermediate conveying roller and the first nipping roller inclines outwardly with respect to the vertical direction, and a tangential direction toward the downstream side at a contact point between the intermediate conveying roller and the second nipping roller inclines outwardly with respect to the vertical direction, and wherein a rotation direction of the intermediate conveying roller is reversed during conveyance of the returned recording medium to the double-side printing conveying unit.

* * * * *